US007120370B2

(12) United States Patent
Watabe

(10) Patent No.: US 7,120,370 B2
(45) Date of Patent: Oct. 10, 2006

(54) IMAGE FORMING APPARATUS

(75) Inventor: Tomonori Watabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 268 days.

(21) Appl. No.: 10/898,868

(22) Filed: Jul. 26, 2004

(65) Prior Publication Data

US 2005/0025511 A1 Feb. 3, 2005

(30) Foreign Application Priority Data

Jul. 29, 2003 (JP) ..... 2003-281547

(51) Int. Cl.
*G03G 15/20* (2006.01)

(52) U.S. Cl. ..... 399/67; 399/68; 399/69; 399/43

(58) Field of Classification Search ..... 219/216; 399/67–69, 70, 320, 322, 328, 329, 330, 399/331, 43
See application file for complete search history.

(56) References Cited

U.S. PATENT DOCUMENTS

| | | | | |
|---|---|---|---|---|
| 5,493,380 | A * | 2/1996 | Saitou et al. | 399/328 |
| 6,782,231 | B1 * | 8/2004 | Fuma et al. | 399/328 |
| 6,904,257 | B1 * | 6/2005 | Tomatsu | 399/328 |

FOREIGN PATENT DOCUMENTS

| | | |
|---|---|---|
| JP | 10063132 A | 3/1998 |
| JP | 2000-338817 A | 12/2000 |

* cited by examiner

*Primary Examiner*—Hoang Ngo
(74) *Attorney, Agent, or Firm*—Akin Gump Strauss Hauer & Feld, LLP

(57) ABSTRACT

In a duplex printing or a simplex printing, upper and lower rollers of a fixing unit are separated from each other or stop rotating during a period after the fixing operation of the first side of a recording medium (or a preceding recording medium) and before the fixing operation of the second side of the recording medium (or a subsequent recording medium). With such an arrangement, it is possible to prevent the excessive heating of the lower roller, and thereby to prevent the degradation of the printed image.

15 Claims, 8 Drawing Sheets

IMAGE FORMING APPARATUS

BACKGROUND OF THE INVENTION

This invention relates to an image forming apparatus, and particularly to an arrangement for fixing a recording material such as toner to a recording medium.

In an image forming apparatus, a recording material such as toner, ink or the like is used to form an image on a recording medium such as a paper. The recording medium with the image formed thereon is nipped by heated rollers so that the recording material is fixed to the recording medium. There is a type of image forming apparatus that has a duplex printing function, i.e., a function to form images on both sides of the recording medium.

In the image forming apparatus of this type, a plurality of recording media with no image formed thereon are stacked in a feeding tray. The recording medium is fed from the feeding tray to an image forming unit, and an image is transferred to a first side of the recording medium. The recording medium is then fed to a fixing unit, and the image is fixed to the first side of the recording medium by means of the rollers of the fixing unit. After the image is fixed to the first side of the recording medium, the recording medium is turned upside down by a turning mechanism, and again fed to the image forming unit by a duplex feeding mechanism. In the image forming unit, an image is formed on a second side of the recording medium.

After the image is formed on the second side of the recording medium, the image is fixed to the second side of the recording medium as in the case of the first side of the recording medium. Then, the recording medium is ejected through an ejection path, and a duplex printing is completed. As described above, in the duplex printing, there is a time interval between the fixing operations of the first side and the second side of the recording medium. Such an image forming apparatus is disclosed in, for example, Japanese Kokai Publication No. 2000-338817 (in particular, page 4 and FIG. 1).

However, because of the above described time interval between two fixing operations, upper and lower rollers of the fixing unit directly contact each other and rotate with each other for a relatively long time. Therefore, heat may transfer, for example, from the upper roller to the lower roller, and therefore the temperature of the lower roller becomes higher than a target temperature even when a heater built in the lower roller is turned off. During the fixing operation of the second side, the first side contacts the lower roller, and therefore the image that has already been fixed to the first side may be molten because of the high temperature of the lower roller. Therefore, the fixed image may become uneven and a hot offset may occur. The hot offset is a phenomenon that a part of the recording material adheres to the excessively heated roller (i.e., the lower roller) and separates from the recording medium.

Moreover, in a simplex printing in which the image is formed on only one side of the recording medium, if there is a relatively long time interval between fixing operations of the preceding recording medium and the subsequent recording medium, the lower roller may be excessively heated. In such a case, the brightness of the image may be unstable, and the image quality may be degraded.

SUMMARY OF THE INVENTION

An object of the present invention is to provide an image forming apparatus capable of preventing an excessive heating of rollers of a fixing unit and capable of ensuring stable printing.

The present invention provides an image forming apparatus including a feeding mechanism that feeds a recording medium, an image forming unit that transfers an image of a recording material to the recording medium fed by the feeding mechanism, a heating member that applies heat to the image on the recording medium, a pressing member provided in opposition to the heating member, an urging member that urges the pressing member against the heating member with the recording medium being pressed between the heating member and the pressing member, and a control system that determines an interval between a preceding recording medium and a subsequent recording medium fed next to the preceding recording medium. The control system causes the urging member to release urging the pressing member when the control system determines that the interval is greater than a predetermined value.

The present invention also provides an image forming apparatus including a feeding mechanism that feeds a recording medium, an image forming unit that transfers an image of a recording material to the recording medium fed by the feeding mechanism, a heating member that applies heat to the image on the recording medium and rotates to feed the recording medium in a predetermined direction, a pressing member provided in opposition to the heating member, an urging member that urges the pressing member against the heating member with the recording medium being pressed between the heating member and the pressing member, and a control system that determines an interval between a preceding recording medium and a subsequent recording medium fed next to the preceding recording medium. The control system causes the heating member to stop rotating for a predetermined period when the control system determines that the interval is greater than a predetermined value.

The present invention also provides an image forming apparatus having a function to perform first and second operations for respectively forming images on first and second sides of a recording medium. The image forming apparatus includes a feeding mechanism that feeds the recording medium, an image forming unit that transfers the image of a recording material to the recording medium fed by the feeding mechanism, a heating member that applies heat to the image on the recording medium and rotates to feed the recording medium in a predetermined direction, a pressing member provided in opposition to the heating member, an urging member that urges the pressing member against the heating member with the recording medium being pressed between the heating member and the pressing member, a medium detection unit that detects the recording medium fed by the feeding mechanism at a predetermined position and outputs a detection signal, and a control unit that causes the urging member to urge the pressing member against the heating member with the recording member being pressed between the heating member and the pressing member only during a first period in accordance with the detection signal in the first operation. The control unit causes the urging member to urge the pressing member against the heating member only during a second period in accordance with the detection signal in the second operation.

The present invention also provides an image forming apparatus having a function to perform first and second operations for respectively forming images on first and second sides of a recording medium. The image forming apparatus includes a feeding mechanism that feeds the recording medium, an image forming unit that transfers the image of a recording material to the recording medium fed by the feeding mechanism and rotates to feed the recording medium in a predetermined direction, a heating member that applies heat to the image on the recording medium and rotates to feed the recording medium in a predetermined direction, and a pressing member provided in opposition to the heating member, an urging member that urges the pressing member against the heating member with the recording medium being pressed between the heating member and the pressing member, a medium detection unit that detects the recording medium fed by the feeding mechanism at a predetermined position and outputs a detection signal, and a control unit that causes the urging member to urge the pressing member during a third period. The third period starts in accordance with the detection signal in the first operation. The third period ends in accordance with an end of the detection signal in the second operation. The control unit causes the heating member to stop rotating during a fourth period within the third period. The fourth period starts in accordance with an end of the detection signal in the first operation. The fourth period ends in accordance with the detection signal in the second operation.

The present invention also provides an image forming apparatus that forms an image of a recording material on a recording medium. The image forming apparatus includes a thickness detection unit that detects the thickness of the recording medium, a fixing unit that fixes the image to the recording medium at a fixing temperature corresponding to a thickness of the recording medium, and a control system that determines the fixing temperature based on first, second and third set temperatures respectively corresponding to first, second and third thicknesses of the recording medium. The second thickness is thicker than the first thickness. The third thickness is thicker than the second thickness. The second set temperature is higher than the first set temperature. The third set temperature is higher than the second temperature. A set temperature substantially linearly increases from the first set temperature to the second set temperature as the thickness of the recording medium increases from the first thickness to the second thickness. A set temperature substantially linearly increases from the second set temperature to the third set temperature as the thickness of the recording medium increases from the second thickness to the third thickness. A rate of increase of the set temperature is smaller when the thickness of the recording medium is between the first and second thicknesses than when the thickness of the recording medium is between the second and third thicknesses.

The present invention also provides an image forming apparatus that forms an image of a recording material on a recording medium. The image forming apparatus includes a thickness setting system for setting a thickness of the recording medium, a fixing unit having first and second rollers each of which has a heater, the first and second rollers nip the recording medium therebetween and rotate to feed the recording medium, a temperature of the second roller being lower than a temperature of the first roller, and a control system that drives the heaters to control temperatures of the first and second rollers according to the thickness of the recording medium. The temperature of the second roller substantially linearly increases as the thickness of the recording medium increases, and a rate of increase of the temperature is greater when the thickness of the recording medium is thicker than a predetermined thickness than when the thickness of the recording medium is thinner than the predetermined thickness.

With such an arrangement, when the image is fixed to one side of the recording medium, the other side of the recording medium can be prevented from being excessively heated, and therefore it becomes possible to perform a stable fixing operation without causing the degradation of the image.

Moreover, when the image is fixed to one side of the recording medium, the other side of the recording medium can be kept at a predetermined temperature corresponding to the thickness of the recording medium, and therefore it becomes possible to prevent a hot offset even when a thin recording medium is used, and to prevent a cold offset even when a thick recording medium is used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Embodiments of the present invention will be described with reference to the attached drawings.

Embodiment 1.

Figure 1:
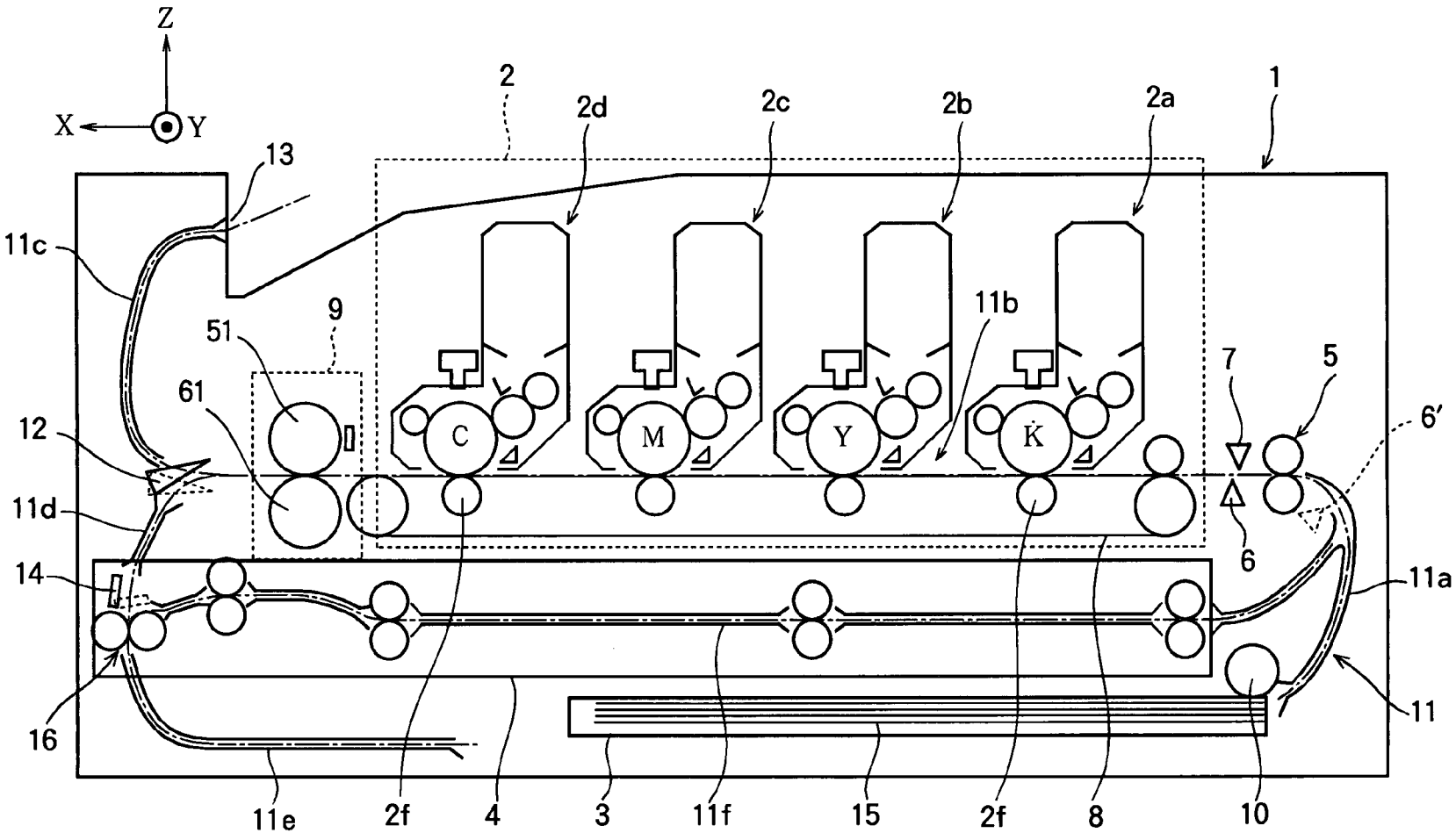
FIG. 1 is a schematic front view of an image forming apparatus according to Embodiment 1 of the present invention.

FIG. 1 is a schematic front view of an image forming apparatus according to Embodiment 1 of the present invention.

The image forming apparatus 1 includes a cassette mounting portion to which a feeding tray 3 is mounted. In the feeding tray 3, a stack of recording media 15 (for example, recording papers) is accommodated. The image forming apparatus 1 further includes a duplex feeding unit 4 that feeds the recording medium 15 along a feeding path 11 and turns the recording sheet 15 upside down. The image forming apparatus 1 further includes a print process unit 2 that feeds the recording medium 15 along a feeding path 11, and transfers a toner image to the recording medium 15. The image forming apparatus 1 further includes a fixing unit 9 that fixes the toner image to the recording medium 15.

The uppermost recording medium 15 of the stack accommodated in the feeding tray 3 is picked up by a hopping roller 10 and fed into a feeding path 11*a*. The leading edge of the recording medium 15 abuts against resist rollers 5 so that the skew of the recording medium 15 is corrected. The resist rollers 5 rotate to feed the recording medium 15 into the print process unit 2. In the print process unit 2, a feeding belt 8 absorbs the recording medium 15 by means of static electricity, and feeds the recording medium 15 along a feeding path 11*b*.

The print process unit 2 has four developing units 2*a*, 2*b*, 2*c* and 2*d* of black (K), yellow (Y), magenta (M) and cyan (C) arranged along the feeding path 11*b* in this order from upstream to downstream. Transfer rollers 2*f* are provided respectively in opposition to photosensitive drums of the developing units 2*a*, 2*b*, 2*c* and 2*d* via the feeding belt 8. Electrophotographic processes, i.e., charging, exposure, developing, and transferring processes are performed by the developing units 2*a*, 2*b*, 2*c* and 2*d* and the transfer rollers 2*f*, and therefore the toner images of the respective colors are transferred to a first side (i.e., a right face) of the recording medium 15.

The recording medium 15 is fed into the fixing unit 9 in which the toner image is fixed to the first side of the recording medium 15. After the recording medium 15 passes the fixing unit 9, the recording medium 15 is fed through a feeding path selected by a path selection guide 12.

In a simplex printing mode in which the image is formed on one side of each recording medium 15, the recording medium 15 is guided by the path selection guide 12 shifted as indicated by a dashed line in FIG. 1, and fed along a feeding path 11*c* and ejected through an eject port 13. Conversely, in the duplex printing mode, the recording medium 15 is guided by the path selection guide 12 shifted as indicated by a solid line in FIG. 1, and fed along a feeding path 11*d*. Further, the recording medium 15 is guided by a path selection guide 14 (of the duplex feeding unit 4) shifted as indicated by a solid line in FIG. 1, and fed by feeding rollers 16 rotating in normal directions into a feeding path (i.e., a retraction path) 11*e* formed at the lower side of the duplex feeding unit 4. When the feeding rollers 16 rotate in the reverse directions, and the path selection guide 14 shifts as indicated by the dashed line in FIG. 1, the recording medium 15 is fed through a feeding path 11*f* (i.e., a return path) of the duplex feeding unit 4, and fed through the feeding path 11*b* in the print process unit 2, in which the image is transferred to a second side (i.e., a back face) of the recording medium 15. The recording medium 15 is fed through the fixing unit 9, in which the image is fixed to the second side of the recording medium 15. The recording medium 15 is guided by the path selection guide 12 shifted as indicated by the dashed line in FIG. 1, and is ejected through the eject port 13.

A medium detection sensor 6 (i.e., a medium detection unit) is disposed along the feeding path at the downstream side of the resist rollers 5. The medium detection sensor 6 detects the passage of the recording medium 15, and outputs a medium detection signal for determining whether the recording medium 15 is passing the medium detection sensor 6 to a control unit 101 (FIG. 3) described later. A thickness sensor 7 (i.e., a thickness detection unit) is provided in opposition to the medium detection sensor 6. The thickness sensor 7 outputs the thickness information signal to the control unit 101 (FIG. 3) for the calculation of the thickness of the recording medium 15. The above described mechanism for feeding the recording medium 15 along the feeding path 11 constitutes a feeding mechanism. The developing units 2*a*, 2*b*, 2*c* and 2*d* and the transfer rollers 2*f* of the print process unit 2 constitute an image forming unit.

In FIG. 1, Y-axis is defined to be parallel to the rotation axes of the transfer rollers 2*f*. The X-axis is defined to be parallel to the direction in which the transfer rollers 2*f* are arranged. Z-axis is defined to be perpendicular to the X-axis and Y-axis. The positive direction along X-axis corresponds to the feeding direction of the recording medium 15 in the print process unit 2.

Figure 2B:
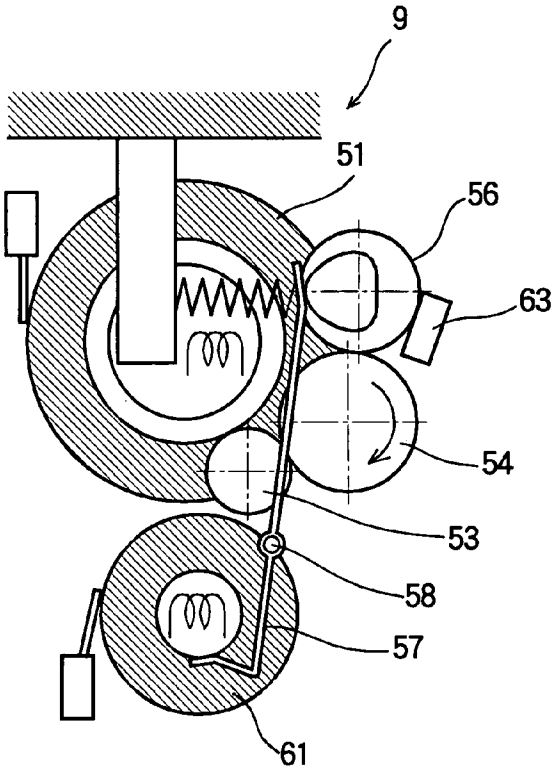
FIGS. 2A and 2B are schematic views illustrating the internal structure and the operation of a fixing unit of the image forming apparatus according to Embodiment 1 of the present invention.
Figure 2A:
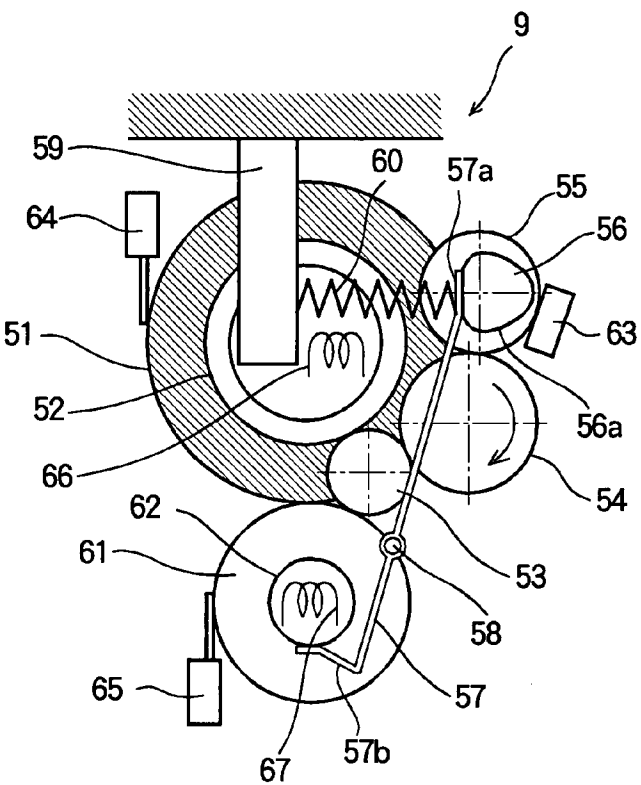

FIGS. 2A and 2B are schematic views illustrating the internal structure and the operation of the fixing unit 9. In FIGS. 2A and 2B, X-axis, Y-axis and Z-axis respectively correspond to those in FIG. 1. FIGS. 2A and 2B correspond to back views of the fixing unit 9 seen from the back of FIG. 1.

In FIG. 2A, an upper roller 51 is integrally provided with a driven gear 52. The driven gear 52 engages a drive gear 53 fixed to a not shown rotation shaft of a fixing motor 103 (FIG. 3), and therefore the upper roller 51 is rotated by the rotation of the drive gear 53. The drive gear 53 engages an one-way gear 54, and the one-way gear 54 engages a cam gear 55. The one-way gear 54 does not transmit the rotation from the drive gear 53 to the cam gear 55 when the drive gear 53 rotates about Y-axis in the normal direction indicated by an arrow A, i.e., in the direction in which the recording medium 15 (FIG. 1) is fed in the positive direction along X-axis. The one-way gear 54 transmits the rotation from the drive gear 53 to the cam gear 55 when the drive gear 53 rotates in the reverse direction indicated by an arrow B.

The cam gear 55 is integrally provided with an eccentric cam 56, and rotates together with the eccentric cam 56. A lever 57 is supported by a main body of the fixing unit 9 and swingable about a support pin 58. The lever 57 has an engaging end portion 57*a* at the upper end thereof. The engaging end,portion 57*a* is urged against a circumferential surface 56*a* of the eccentric cam 56 by means of a compression spring 60. The compression spring 60 is disposed between the engaging end portion 57*a* and a post 59 fixed to the main body of the fixing unit 9. Thus, when the cam gear 55 rotates, the lever 57 swings about the support pin 58 in accordance with a cam profile of the eccentric cam 56.

The lower roller 61 is supported by the main body of the fixing unit 9 so that the lower roller 61 is slidable between an operating position shown in FIG. 2A and a standby position shown in FIG. 2B. In the operating position (FIG.

2A), the lower roller 61 is urged against the upper roller 51. In the standby position (FIG. 2B), the lower roller 61 is separated from the upper roller 51. The lower roller 61 has a lower toller shaft 62. The circumferential surface of the lower roller shaft 62 contacts an L-shaped end portion 57*b* formed at the lower end of the lever 57 via a bearing. Therefore, the movement of the lower roller 61 in the negative direction along Z-axis (i.e., downward) because of its own weight is restricted by the lever 57, while the rotation of the lower roller 61 is allowed.

In a state where the eccentric cam 56 of the cam gear 55 is in the position shown in FIG. 2A, the lever 57 swings about Y-axis to an end of the swingable range in the direction indicated by the arrow A, and keeps the lower roller 61 at the operating position in which the lower roller 61 is urged against the upper roller 51. In a state where the eccentric cam 56 of the cam gear 55 is in the position shown in FIG. 2B, the lever 57 swings about Y-axis to an end of the swingable range in the direction indicated by the arrow B, and keeps the lower roller 61 at the standby position in which the lower roller 61 is separated from the upper roller 51. A cam position sensor 63 detects the eccentric cam 56 when the eccentric cam 56 is in the operating position shown in FIG. 2A, and outputs the position information signal regarding the position of the eccentric cam 56 to the control unit 101 (FIG. 3) described later.

The eccentric cam 56 rotates when the drive gear 53 (whose rotation can be transmitted to the cam gear 55 by the one-way gear 54) rotates about Y-axis in the reverse direction indicated by the arrow B in accordance with a timing chart described later.

Therefore, in a state where the eccentric cam 56 is in the operating position shown in FIG. 2A, when the drive gear 53 rotates in the normal direction indicated by the arrow A, the rotation of the upper roller 51 is directly transmitted to the lower roller 61 because the lower roller 61 is urged against the upper roller 51. In this case, the upper and lower rollers 51 and 61 feed the recording medium 15 (FIG. 1) in the positive direction along X-axis so that the image is fixed to the recording medium 15. In a state where the eccentric cam 56 is in the standby position shown in FIG. 2B, when the drive gear 53 rotates in the normal direction indicated by the arrow A, the rotation of the upper roller 51 is not transmitted to the lower roller 61 because the upper and lower rollers 51 and 61 are separated from each other. In this case, the recording medium 15 is not fed, and the image is not fixed to the recording medium 15.

An upper roller temperature sensor 64 is provided in the vicinity of the upper roller 51. The upper roller temperature sensor 64 detects the surface temperature of the upper roller 51, and outputs a temperature information signal to the control unit 101 (FIG. 3) described later. A lower roller temperature sensor 65 detects the surface temperature of the lower roller 61, and outputs a temperature information signal to the control unit 101 described later. Each of the roller temperature sensors 64 and 65 is of contact type, and has a temperature detecting portion in the form of a plate spring urged against the surface of the each roller. An upper roller heater 66 is provided in the upper roller 51 for heating the upper roller 51. A lower roller heater 67 is provided in the lower roller 61 for heating the lower roller 61. The upper roller 51 corresponds to a heating member, and the lower roller 61 corresponds to a pressing member.

Figure 3:
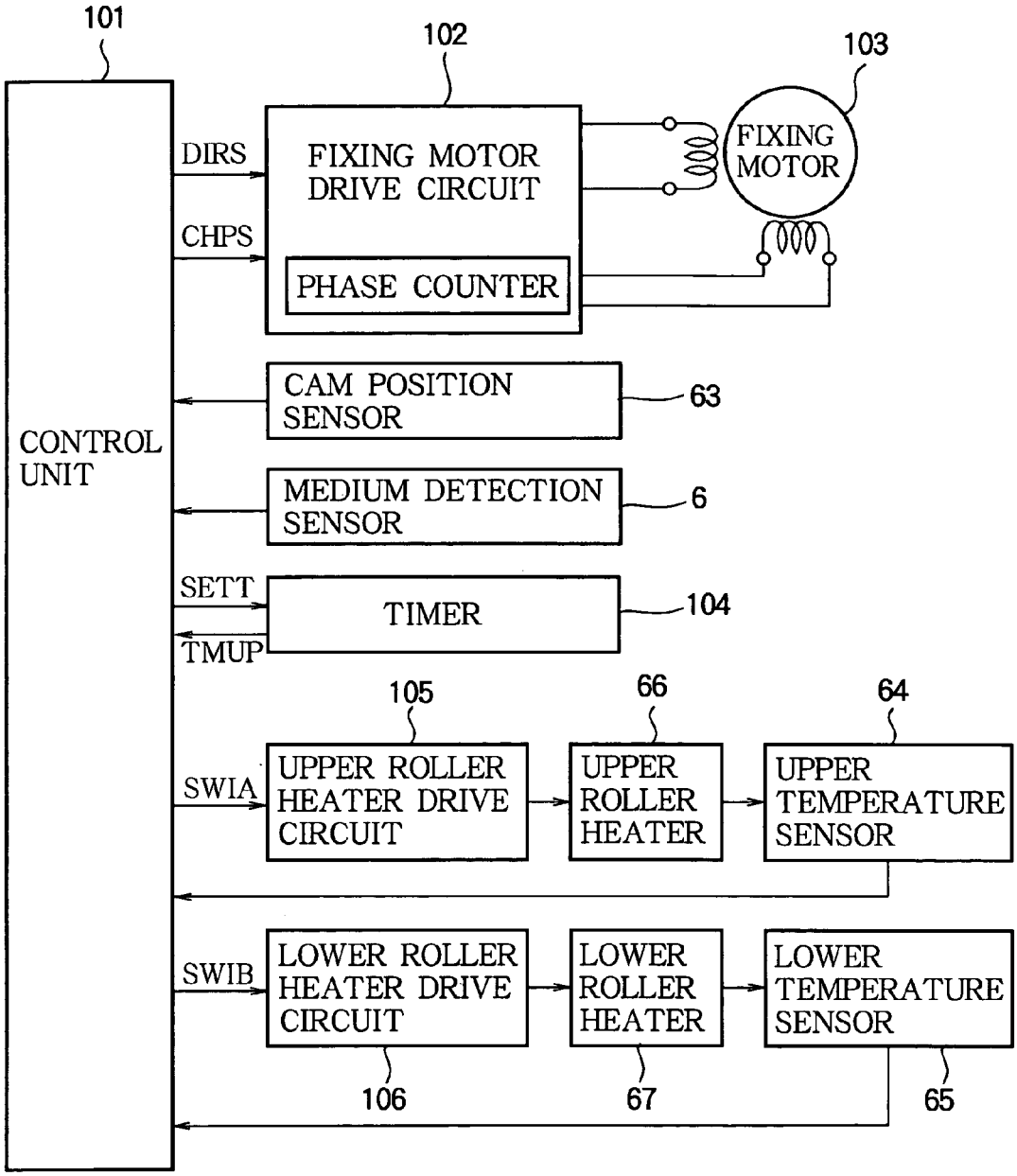
FIG. 3 is a block diagram of a control system for controlling the operation of the main part of the image forming apparatus according to Embodiment 1 of the present invention.
Figures 4A, 4B, 4C, 4D, 4E, 4F:
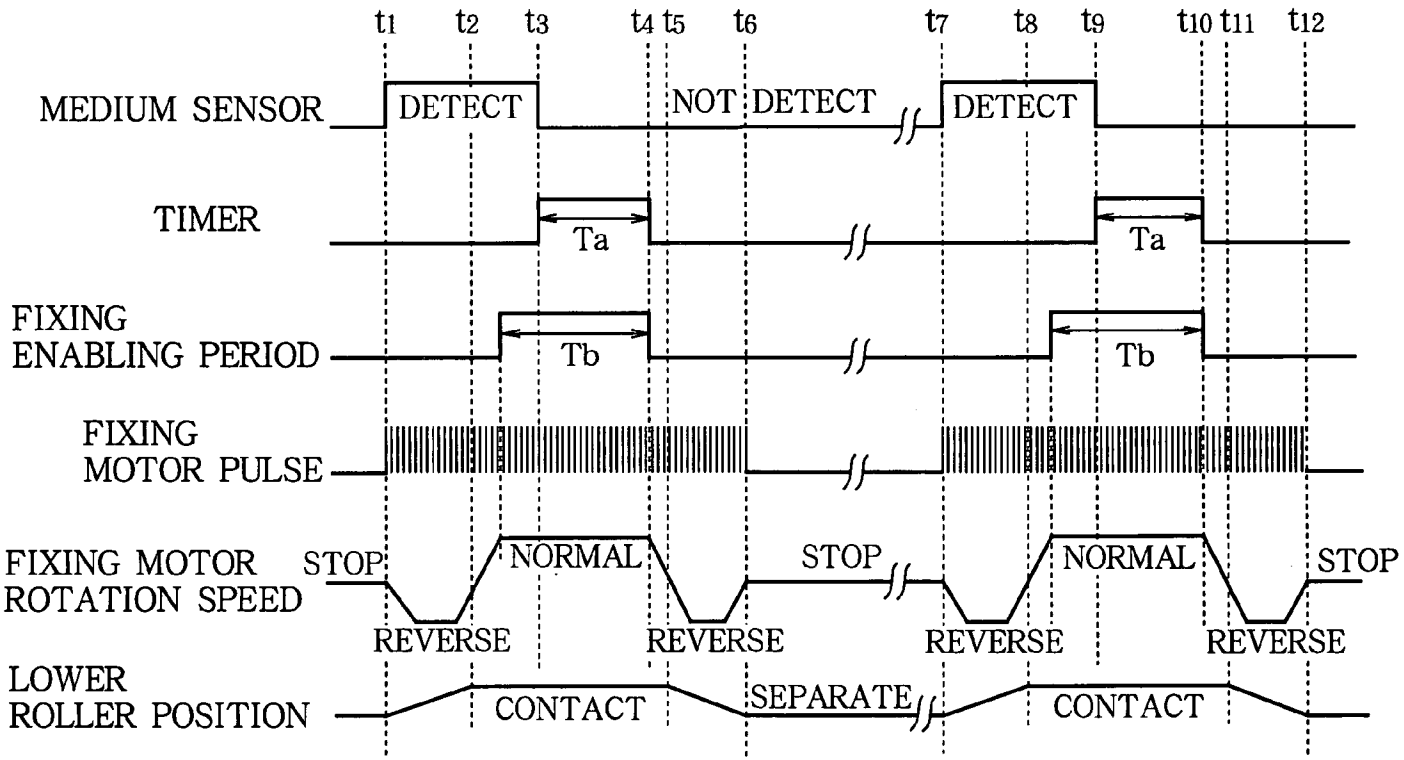
FIGS. 4A through 4F are timing charts illustrating the operation of the image forming apparatus according to Embodiment 1 of the present invention.
Figures 5A, 5B, 5C, 5D, 5E, 5F:
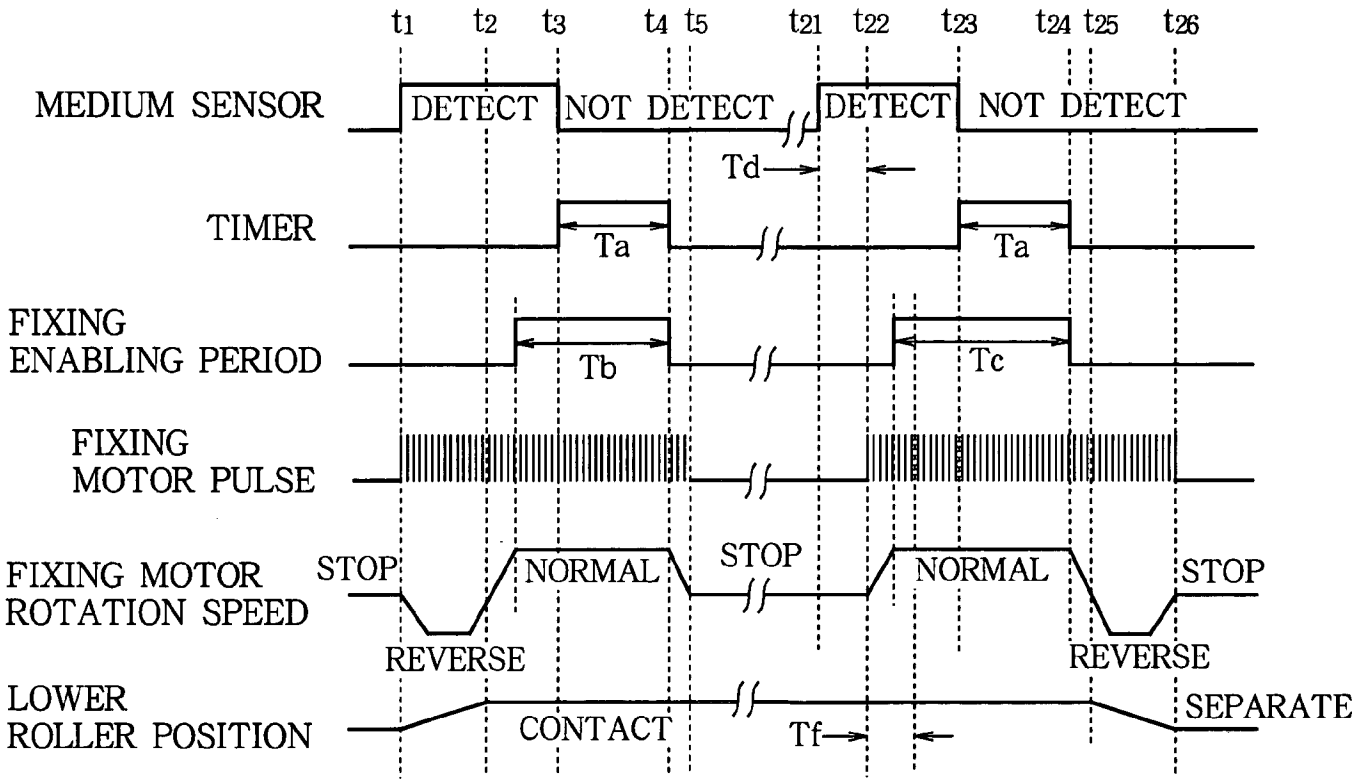
FIGS. 5A through 5F are timing charts illustrating the operation of an image forming apparatus according to Embodiment 2 of the present invention.

FIG. 3 is a block diagram of a control unit that controls the operation of the main part of the image forming apparatus 1 according to Embodiment 1.

In FIG. 3, the control unit 101 includes a microprocessor, and controls the operation sequence of respective blocks. The fixing motor 103 is a two-phase stepping motor driven by phase excitation signal from a fixing motor drive circuit 102. When the fixing motor 103 rotates, the drive gear 53 (FIGS. 2A and 2B) fixed to the rotation shaft of the fixing motor 103 also rotates. The fixing motor drive circuit 102 includes a driver circuit for exciting the fixing motor 103 and a phase counter for keeping the excitation phase. Based on a rotating direction signal DIRS and an excitation phase switching pulse signal CHPS from the control unit 101, the fixing motor drive circuit 102 performs the phase switching in the normal and reverse rotating directions with a pulse rate determined by a pulse interval of the excitation phase switching pulse signal.

The control unit 101 receives the medium detection signal from the medium detection sensor 6 disposed at the upstream side of the fixing unit 9 (FIG. 1). According to the medium detection signal, the control unit 101 determines whether the recording medium 15 is passing the medium detection sensor 6 or not. The control unit 101 receives the temperature information signals from the roller temperature sensors 64 and 65 of the upper and lower rollers 51 and 61 (FIG. 2), and transforms the temperature information signal into digital data so as to detect the temperatures of the upper and lower rollers 51 and 61.

Figure 2A:
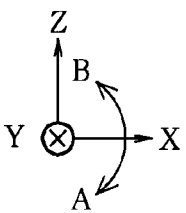

An upper roller heater drive circuit 105 is provided for driving the upper roller heater 66 (FIG. 2). The upper roller heater drive circuit 105 receives an on/off signal SWIA from the control unit 101, and turns the upper roller heater 66 on and off according to the on/off signal SWIA. Similarly, a lower roller heater drive circuit 106 receives an on/off signal SWIB from the control unit 101, and turns the lower roller heater 67 on and off according to the on/off signal SWIB. The control unit 101 outputs the on/off signal SWIA and SWIB according to the temperatures detected by the upper and lower roller temperature sensors 64 and 65 so as to keep the temperatures of the upper and lower rollers 51 and 61 at the predetermined temperatures.

Further, the control unit 101 is connected to a timer 104. The timer 104 is set to a time according to a time setting signal SETT from the control unit 101. The timer 104 outputs time-up signal TMUP to the control unit 101 when the counting has completed.

FIGS. 4A through 4*f* are timing charts illustrating the operation of the image forming apparatus 1 according to Embodiment 1. The operation of the image forming apparatus 1 according to Embodiment 1 will be described with reference to FIGS. 4A through 4F. In Embodiment 1, the temperatures of the upper and lower rollers 51 and 61 are respectively controlled to be predetermined temperatures. Further, the temperature of the lower roller 61 is lower than that of the upper roller 51.

When the printing starts, the recording medium 15 is fed through the feeding path 11*a* to reach the print process unit 2. In the print process unit 2, the recording medium 15 is fed along the feeding path 11*b*, and the toner of the respective colors are transferred to the first side (i.e., the right face) of the recording medium 15. Further, the recording medium 15 is fed to the fixing unit 9.

During the feeding of the recording medium 15, the medium detection sensor 6 detects the leading edge of the recording medium 15 passing a detection point of the medium detection sensor 6 at time t1. The medium detection sensor 6 starts outputting the medium detection signal of H-level to the control unit 101, indicating that the recording medium 15 is passing the medium detection sensor 6. The medium detection sensor 6 keeps the detection signal at H-level until the medium detection sensor 6 detects the trailing edge of the recording medium 15 passing the detection point at time t3. When the control unit 101 recognizes the medium detection signal of H-level at time t1, the control unit 101 drives the fixing motor 103 in the reverse direction to rotate the eccentric cam 56 so that the lower roller 61 moves from the standby position (FIG. 2B) toward the operating position (FIG. 2A). The control unit 101 stops the fixing motor 103 when the cam position sensor 63 detects that the lower roller 61 reaches the operating position (FIG. 2A) at time t2, in which the lower roller 61 is urged against the upper roller 51.

Then, the control unit 101 drives the fixing motor 103 in the normal direction (indicated by the arrow A) so as to enable the upper and lower rollers 51 and 61 to nip the recording medium 15 and feed the recording medium 15 at a constant speed. This condition continues for a predetermined period referred to as a fixing enabling period Tb. After the beginning of the fixing enabling period Tb, the recording medium 15 reaches the fixing unit 9, and the image is fixed to the recording medium 15. In this regard, the position of the medium detection sensor 6 is so determined that the recording medium 15 reaches the fixing unit 9 after the fixing enabling period Tb begins.

Then, when the control unit 101 recognizes that the trailing edge of the recording medium 15 passes the detection point of the medium detection sensor 6 at time t3, the control unit 101 starts counting a predetermined period Ta using the timer 104. When the period Ta has elapsed at time t4, the control unit 101 reduces the rotation speed of the fixing motor 103, and the fixing enabling period Tb ends. Next, the control unit 101 changes the rotating direction of the fixing motor 103 from the normal direction to the reverse direction at time t5. The control unit 101 keep rotating the fixing motor 103 in the reverse direction so that the driving gear 53 rotates the eccentric cam 56 via the one-way gear 54 until the eccentric cam 56 reaches the standby position shown in FIG. 2B at time t6. In FIGS. 4A through 4F, the period Tb that starts immediately after time t2 corresponds to a first period.

In this state, as shown in FIG. 2B, the lower roller 61 is in a standby position and is separated from the upper roller 51. The above described period Ta set to the timer 104 is so determined that the fixing enabling period Tb ends after the fixing unit 9 completes the fixing of the recording medium 15.

The recording medium 15 that has passed the fixing unit 9 is fed along the feeding path lid by means of the path selection guides 12 and 14 shifted as indicated by the solid lines in FIG. 1, and once retracted in the feeding path (i.e., the retraction path) lie. Then, the path selection guide 14 shifts as indicated by the dashed line in FIG. 1 and the feeding rollers 16 start rotating in the reverse directions, so that the recording medium 15 is fed along the feeding path 11*f*. Further, the recording medium 15 reaches the resist rollers 5 correcting the skew of the recording medium 15, and is fed into the print process unit 2 with the second side (i.e., the back face) of the recording medium 15 facing upward.

Then, the recording medium 15 with the second side facing upward passes the medium detection sensor 6. By the developing units 2*a*, 2*b*, 2*c* and 2*d* and the transfer rollers 2*f*, the toner image of the respective colors are transferred to the second side of the recording medium 15. The recording medium 15 that has passes the fixing unit 9 is guided by the path selection guide 12 that shifts as indicated by the dashed line in FIG. 1, and is ejected through the feeding path 11*c* and the eject port 13. In this operation, when the medium detection sensor 6 detects the leading edge of the recording medium 15 at time t7, the processes from time t7 to time t12 (i.e., when the fixing motor 103 stops rotating) are performed. The processes from time t7 to time t12 are the same as the above described processes from time t1 to time t6, and therefore the descriptions thereof are omitted. In FIGS. 4A through 4F, a fixing enabling period Tb that starts immediately after time t8 corresponds to a second period.

Moreover, during the continuous printing in the simplex printing mode, the path selection guide 12 is fixed in a position indicated by the solid line in FIG. 1, and the processes from time t1 to time t6 shown in FIGS. 4A through 4F are repeated every time the feeding medium 15 (fed from the feeding tray 3) passes the medium detection sensor 6.

In Embodiment 1, the fixing unit 9 has two rollers for fixing the image to the recording medium 15. However, it is possible to use one or two timing belts instead of one or two rollers for nipping and heating the recording medium 15. In this case, the nipping and releasing of the recording medium 15 can be performed as described above.

As described above, according to the image forming apparatus 1 of Embodiment 1, the upper and lower rollers 51 and 61 are separated from each other in the time interval between the fixing operations of the first and second sides of the recording medium 15. Thus, it is possible to prevent the transfer of heat from the upper roller 51 to the lower roller 61, and therefore it is possible to prevent the excessive heating of the lower roller 61. Accordingly, even when the first side of the recording medium 15 contacts the lower roller 61 in the fixing operation of the second side, the temperature of the lower roller can be limited to below a predetermined temperature, and therefore the excessive heating of the first side of the recording medium 15 can be prevented. Thus, unevenness of the fixed image and the hot offset can be prevented.

In addition, during the continuous printing in the simplex printing mode, the upper and lower rollers 51 and 61 are separated from each other in the time interval between the fixing operations of the preceding recording medium 15 and the subsequent recording medium 15. Thus, the temperature of the lower roller can be limited to below a predetermined temperature, and therefore it is possible to obtain the advantage as is the case with the duplex printing.

Embodiment 2.

FIGS. 5A through 5F are timing charts illustrating the operation of the image forming apparatus according to Embodiment 2 of the present invention. With reference to FIGS. 5A through 5F, the operation of the image forming apparatus according to Embodiment 2 will be described.

The structure of the image forming apparatus of Embodiment 2 can be the same as that of the image forming apparatus 1 (FIG. 1) of Embodiment 1. The structure of the control unit 101 of the image forming apparatus of Embodiment 2 is the same as that of the image forming apparatus (FIG. 3) of Embodiment 1. Only a part of the operation of the control unit 101 of Embodiment 2 is different from that of Embodiment 1. Therefore, FIGS. 1 through 3 are referred in the description of Embodiment 2.

In the printing operation, the processes from time t1 (i.e., when the medium detection sensor 6 detects the leading edge of the recording medium 15) to time t5 (i.e., when the fixing operation is completed and the fixing motor 103 stops rotating in the normal direction) are the same as the processes from time t1 to time t5 shown in FIGS. 4A through 4F described above, and therefore the descriptions thereof are omitted.

In Embodiment 2, the reverse rotation of the fixing motor 103, i.e., the separation of the upper and lower rollers 51 and 61 is not performed after time t5. Therefore, the following processes are performed from time t5 to time t21 described below in such a manner that the upper and lower rollers 51 and 61 contact each other and do not rotate.

The recording medium 15 with the toner image fixed to the first side is fed along the feeding paths 11*d*, 11*e* and 11*f* (FIG. 1), so that the recording medium 15 is turned upside down as was described in Embodiment 1. Further, the recording medium 15 passes the detection point of the medium detection sensor 6, and the medium detection sensor 6 detects the leading edge of the recording medium 15 at time t21. When the control unit 101 (FIG. 3) recognizes that the leading edge of the recording medium 15 passes the medium detection sensor 6, the control unit 101 starts counting a period Td using the timer 104. When the period Td elapses at time t22, the control unit 101 starts rotating the fixing motor 103 shown in FIG. 3 in the normal direction.

By the rotation of the fixing motor 103 in the normal direction, the upper and lower rollers 51 and 61 are enabled to fix the image to the recording medium 15, i.e., a fixing enabling period Tc begins. After the fixing enabling period Tc begins, the recording medium 15 reaches the fixing unit 9, in which the image is fixed to the recording medium 15.

The period Td is so determined that the recording medium 15 reaches the fixing unit 9 after the fixing enabling period Tc begins, and that there is a predetermined idle rotation period Tf of the fixing motor 103 after the fixing motor 103 starts rotating in the normal direction at time t22 before the recording medium 15 reaches the fixing unit 9. The idle rotation period Tf is provided for dispersing the heat on the lower roller 61 transferred from the upper roller 51 (because of the contact of the upper and lower rollers 51 and 61 that stop rotating) so that the lower roller 61 is uniformly heated.

When the control unit 101 recognizes that the trailing edge of the recording medium 15 has passed the detection point of the medium detection sensor 6 at a time t23, the control unit 101 starts counting the period Ta using the counter 104. When the period Ta elapses at time t24, the control unit 101 reduces the rotation speed of the fixing motor 103 in the normal direction, and the fixing enabling period Tc ends. Next, the fixing motor 103 switches the rotating direction from the normal direction to the reverse direction at time t25, so that the drive gear 53 rotates the eccentric cam 56 via the one-way gear 54. The fixing motor 103 stops rotating when the eccentric cam 56 reaches the standby position shown in FIG. 2B at time t26. In FIGS. 5A through 5F, the period from time t2 to time t25 corresponds to a third period, and the period from time t5 to time t22 corresponds a fourth period.

In this state, the lower roller 61 is in the standby position and is separated from the upper roller 51 as shown in FIG. 2B. The period Ta counted by the timer 104 is so determined that the fixing enabling period Tc ends after the fixing unit 9 completes the fixing of the recording sheet 15. Then, the recording medium 15 that has passed the fixing unit 9 is guided by the path selection guide 12 shifted as indicated by the dashed line in FIG. 1, fed along the feeding path 11*c*, and ejected through the eject port 13.

Further, during the continuous printing in the simplex printing mode, the path selection guide 12 is fixed to a position indicated by the dashed line in FIG. 1, and the recording media 15 are continuously fed from the feeding tray 3. The fixing operation of the first recording medium 15 includes the above described processes from time t1 to time t5. The fixing operation of each recording medium 15 from the second recording medium 15 to the second-to-last recording medium 15 includes the above described processes from time t21 to time t25. The fixing operation of the last recording medium 15 includes the above described processes from time t21 to time t26 (i.e., the separating process of the upper and lower rollers 51 and 61 is added), and then the continuous printing is completed.

In Embodiment 2, the fixing unit 9 has two rollers for fixing the image to the recording medium 15. However, it is possible to use one or two timing belts instead of one or two rollers for nipping and heating the recording medium 15. In this case, the nipping and releasing of the recording medium 15 can be performed as described above.

As described above, according to the image forming apparatus of Embodiment 2, the upper and lower rollers 51 and 61 stop rotating when the recording medium 15 does not exist between the upper and lower rollers 51 and 61 in the time interval between the fixing operations of the first and second sides of the recording medium 15 in the duplex printing mode. Thus, the transfer of heat from the upper roller 51 to the lower roller 61 can be limited in a part of the lower roller 61. Therefore, while the image is fixed to the second side, it is possible to prevent the lower roller from being excessively heated entirely. Accordingly, it is possible to prevent the first side of the recording medium from being excessively heated, with the result that unevenness of the fixed image and hot offset can be prevented.

In addition, compared with Embodiment 1, it is not necessary to change the rotating direction of the fixing motor 103, and therefore it is possible to save time. Thus, it is possible to feed the recording medium 15 at a high feeding speed and shorten a time interval between the printing operations. Further, in the simplex printing mode, it is possible to stop rotating the upper and lower rollers without separating the upper and lower rollers from each other during the time interval between the fixing operations of the preceding and subsequent recording media, and therefore the same advantage can be obtained.

Embodiment 3.

FIGS. 6A through 6F are timing chart illustrating the operation of the image forming apparatus according to Embodiment 3 of the present invention. With reference to FIGS. 6A through 6F, the operation of the image forming apparatus of Embodiment 3 will be described.

The structure of the image forming apparatus of Embodiment 3 can be the same as that of the image forming apparatus 1 (FIG. 1) of Embodiment 1. The structure of the control unit of the image forming apparatus of Embodiment 3 is the same as that of the image forming apparatus of Embodiment 1 (FIG. 3). Only a part of the operation of the control unit 101 in Embodiment 3 is different from that in Embodiment 1. Therefore, FIGS. 1 through 3 are referred in the description of Embodiment 3. In addition, the description will be made to the continuous printing in the simplex printing mode, and therefore the path selection guide 12 is set to a position indicated by the dashed line in FIG. 1.

When the printing operation starts under the above described condition, the first recording medium 15 is fed along the feeding path 11*a* and reaches to the print process unit 2. While the first recording medium 15 is fed along the feeding path 11*b* in the print process unit 2, the toner images of the respective colors are transferred to the first side of the recording medium 15. Then, the recording medium 15 is fed to the fixing unit 9.

The medium detection sensor 6 detects that the leading edge of the recording medium 15 passes the detecting point of the medium detection sensor 6 at time t1, and outputs the detection signal of H-level indicating that the recording medium 15 is passing the medium detection sensor 6. The medium detection sensor 6 keeps the detection signal of H-level until the trailing edge of the recording medium 15 passes the detecting point of the medium detection sensor 6 at time t3. When the control unit 101 recognizes the medium detection signal of H-level at time t1, the control unit 101 drives the fixing motor 103 in the reverse direction to rotate the eccentric cam 56 so that the lower roller 61 moves from the standby position (FIG. 2B) toward the operating position (FIG. 2A). The control unit 101 stops the fixing motor 103 when the medium detection sensor 6 detects that the lower roller 61 reaches the operating position (FIG. 2A) at time t2, in which the lower roller 61 is urged against the upper roller 51.

Then, the control unit 101 drives the fixing motor 103 in the normal direction so as to enable the upper and lower rollers 51 and 61 to nip the recording media 15 and feed the recording media 15 at a constant speed. This condition continues for a predetermined period referred to as a fixing enabling period Te. After the beginning of the fixing enabling period Te, the recording medium 15 reaches the fixing unit 9, and the image is fixed to the recording medium 15. In this regard, the position of the medium detection sensor 6 is so determined that the recording medium 15 reaches the fixing unit 9 after the fixing enabling period Te begins.

Then, when the control unit 101 recognizes that the trailing edge of the recording medium 15 passes the detection point of the medium detection sensor 6 at time t3, the control unit 101 starts counting the predetermined period ta using the timer 104. The period ta is so determined that the fixing of the recording medium 15 is completed at least during the period ta. During the period ta, the control unit 101 checks whether the leading edge of the second (next) recording medium 15 fed along the feeding path 11*a* reaches the detection point of the medium detection sensor 6.

If the medium detection sensor 6 detects the leading edge of the second recording medium 15 at time t3' during the period Ta, the control unit 101 keeps the rotation of the fixing motor 103 in the normal direction so that the fixing enabling period Te continues, and starts the fixing of the second recording medium 15 that reaches the fixing unit 9.

When the control unit 101 recognizes that the trailing edge of the second recording medium 15 passes the detection position of the medium detection sensor 6 at time t32, the control unit 101 starts counting the period Ta using the timer 104 and checks whether the third recording medium 15 fed along the feeding path 11*a* reaches the detection point of the medium detection sensor 6. If the period Ta elapses before the medium detection sensor 6 detects the third recording medium 15 at time 33, the control unit 101 reduces the rotation speed of the fixing motor 103 in the normal direction and the fixing enabling period Te ends.

Then, the fixing motor 103 changes the rotating direction from the normal direction to the reverse direction at time t34, so that the drive gear 53 rotates the eccentric cam 56 via the one-way gear 54. The fixing motor 103 stops rotating when the eccentric cam 56 reaches the standby position shown in FIG. 2B at time t35. In this state, the lower roller 61 is in the stably position separated from the upper roller 51 as shown in FIG. 2B.

Thereafter, if the subsequent recording medium 15 is detected by the medium detection sensor 6 during the time Ta counted by the timer 104, the control unit 101 continues the rotation of the fixing motor 103 in the normal direction so as to continue the fixing enabling period Ta, and performs the fixing operation of the subsequent recording medium 15 in a similar manner. If the period Ta elapses before the medium detection sensor 6 detects the subsequent recording medium 15, the upper and lower rollers 51 and 61 are separated from each other. If the subsequent recording medium 15 is detected by the medium detection sensor 6 after the upper and lower rollers 51 and 61 are separated from each other, the control unit 101 starts the processes from time t1 (FIGS. 6A through 6F) and the following processes.

In the above described operation, if the subsequent recording media 15 is detected in a state where the upper and lower rollers 51 and 61 of the fixing unit 9 are separated from each other, the control unit 101 recognizes that the upper and lower rollers 51 and 61 are separated from each other based on the cam position signal from the cam position sensor 63, and therefore the control unit 101 is able to command a series of processes starting with the reverse rotation of the fixing motor 103 from time t1 shown in FIGS. 6A through 6F. The control unit 101 and the medium detection sensor 6 correspond to a control system (i.e., a determination unit).

In Embodiment 3, the determination whether the interval between the trailing edge of the preceding recording medium 15 and the leading edge of the subsequent recording medium 15 is greater than the predetermine value or not is based on the time interval in accordance with the detection signal from the medium detection sensor 6. However, it is possible to provide another medium detection sensor 6' (indicated by a dashed line in FIG. 1) along the feeding path 11 of the recording medium 15. With the medium detection sensors 6 and 6', it becomes possible to directly measure the distance without measuring the time interval. In this case, the above described determination can be performed by determining whether the medium detection sensor 6' detects the leading edge of the subsequent recording medium 15 while the preceding recording medium 15 is being detected by the medium detection sensor 6.

Figures 6A, 6B, 6C, 6D, 6E, 6F:
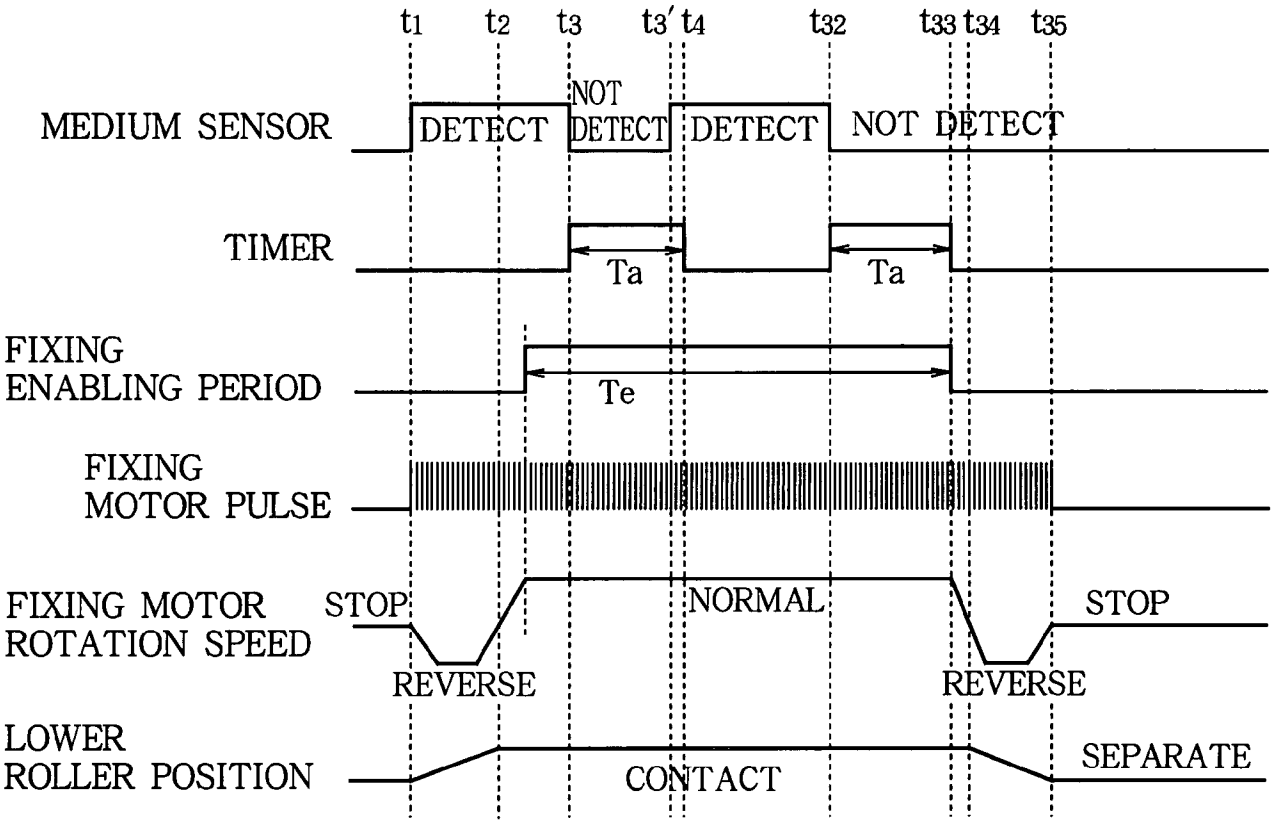
FIGS. 6A through 6F are timing charts illustrating the operation of an image forming apparatus according to Embodiment 3 of the present invention.

Although Embodiment 3 is described in relation to the continuous printing in the simplex printing mode, Embodiment 3 is not limited to the continuous printing in the simplex printing, but can be adapted to the duplex printing as was described in Embodiments 1 and 2. In this case, the period Ta in FIGS. 6B is necessarily set longer in consideration of a time required for turning the recording medium 15 upside down.

Further, in Embodiment 3, if the subsequent recording medium 15 is not detected during the period Ta, the upper and lower rollers 51 and 61 of the fixing unit 9 are separated from each other by means of the processes from time t33 to time t35. However, it is alternatively possible to stop the rotation of the upper roller 51, so that the upper and lower rollers 51 and 61 are pressed against each other without rotating as was described in Embodiment 2. In this case, after the subsequent recording medium 15 is detected, the processes from time t21 shown in FIGS. 5A through 5F and the following processes are performed as was described in Embodiment 2.

As described above, according to Embodiment 3 of the present invention, the upper and lower rollers 51 and 61 are able to separate from each other or to continue the fixing operation, according to the length of the interval between the preceding recording medium 15 and the subsequent recording medium 15. Thus, it becomes possible to restrict the excessive heating of the lower roller 61. Therefore, the stable printing is enabled, and the printing speed can be enhanced.

Embodiment 4.

Figure 7:
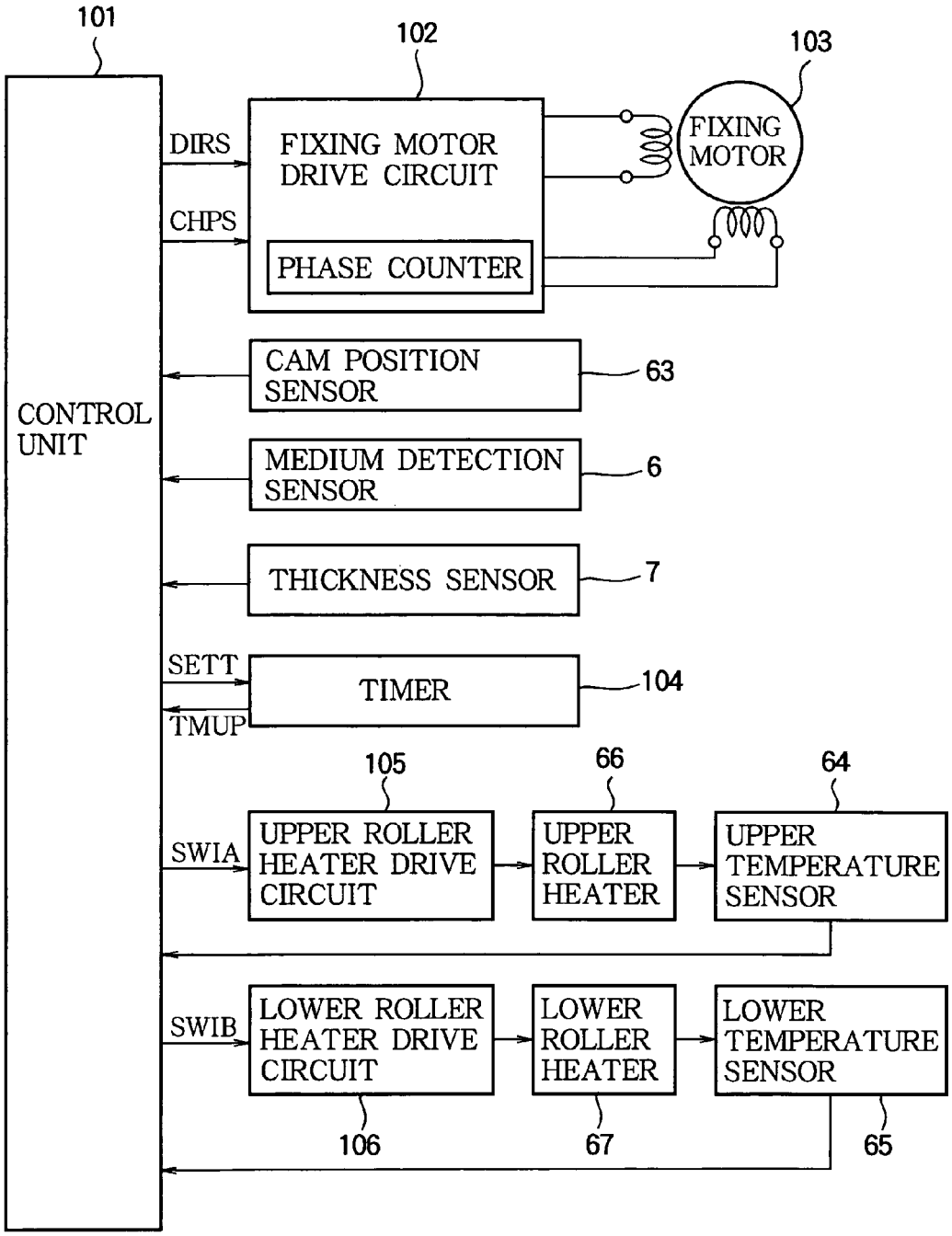
FIG. 7 is a block diagram of a control system for controlling the operation of the main part of an image forming apparatus according to Embodiment 4 of the present invention.

FIG. 7 is a block diagram illustrating the control system for controlling the operation of the main part of the image forming apparatus according to Embodiment 4 of the present invention.

Different from the control system of Embodiment 1, the control system of Embodiment 4 has a block of the thickness sensor 7. Further, a part of the operation of the control system of Embodiment 4 is different from that of Embodiment 1. The components (FIG. 7) in Embodiment 4 that are the same as those described in Embodiment 1 (FIG. 3) are assigned the same reference numbers, and the descriptions thereof are omitted. The structure of the image forming apparatus of Embodiment 4 can be the same as the image forming apparatus 1 of Embodiment 1 (FIG. 1), and therefore the operation will be described with reference to the image forming apparatus 1 as was described in Embodiment 1.

The thickness sensor 7 shown in FIG. 7 is disposed at the same position as the medium detection sensor 6 along the feeding path of the recording medium 15. When the recording medium 15 is detected by the medium detection sensor 6, the thickness sensor 7 measures the thickness of the recording medium 15 and outputs the thickness information signal to the control unit 101.

The feeding of the recording medium 15 and the image forming processes after the recording medium 15 is detected by the medium detection sensor 6 until the recording medium 15 is ejected through the eject port 13 are the same as those described in Embodiment 1, and therefore the descriptions thereof are omitted. In Embodiment 4, the control unit 101 further controls the temperatures of the upper and lower rollers 51 and 61 (FIG. 2) as follows.

In a state where the medium detection sensor 6 does not detect the recording medium 15, the control unit 101 reads the output value of the thickness sensor 7 and stores the output value as an offset value. As the printing operation is started, the thickness sensor 7 again reads the output value of the thickness sensor 6, immediately after the leading edge of the recording medium 15 is detected by the medium detection sensor 6. The control unit 101 subtracts the offset value from the detected value to obtain a medium thickness, and stores the medium thickness. Based on the medium thickness, the control unit 101 sets target temperatures for upper and lower rollers 51 and 61. The thickness sensor 7 and the control unit 101 correspond to a thickness setting system.

The control unit 101 detects the temperature of the upper roller 51 by means of the upper temperature sensor 64 (FIG. 2). Based on the difference between the detected temperature and the target temperature of the upper roller 51, the control unit 101 controls the upper roller heater drive circuit 105 that turns the upper roller heater 66 on and off so that the temperature of the upper roller 51 is stabilized at the target temperature of the upper roller 51. Similarly, the control unit 101 detects the temperature of the lower roller 61 by means of the lower temperature sensor 64, and controls the lower roller heater drive circuit 106 that turns the lower roller heater 67 on and off so that the temperature of the lower roller 61 is stabilized at the target temperature of the lower roller 61. The control unit 101, the upper temperature sensor 64, the upper roller heater drive circuit 105, the lower temperature sensor 65, the lower roller heater drive circuit 106 correspond to a control system.

Figure 8:
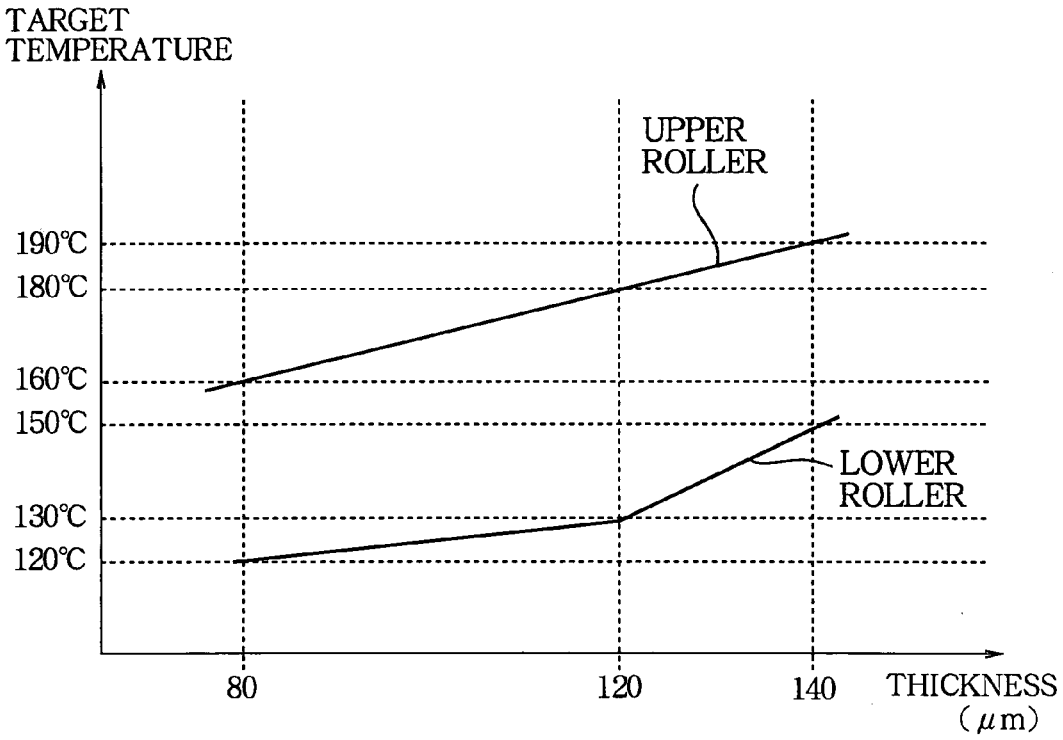
FIG. 8 is a graph illustrating examples of target temperatures of upper and lower rollers of the fixing unit with respect to the thickness of the recording medium.

FIG. 8 is a graph illustrating examples of the target temperatures of the upper and lower rollers 51 and 61 with respect to the thickness of the recording medium 15.

Each of the target temperatures of the upper and lower rollers 51 and 61 is set to increase as the thickness of the recording medium 15 increases. FIG. 8 shows the target temperatures of the upper and lower rollers 51 and 61 as the thickness of the recording medium 15 ranges from 80 μm (60 g/m$^2$) to 140 μm (105 g/m$^2$). As the thickness of the recording medium 15 increases from 80 μm to 140 μm, the target temperature of the upper roller 51 increases at a constant rate. Thus, the amount of heat corresponds to the thickness of the recording medium 15 is applied to the recording medium 15.

The target temperature of the lower roller 61 increases at a constant rate (substantially along a straight line in FIG. 8) as the thickness of the recording medium 15 increases from 80 μm to 120 μm (90 g/m$^2$). Further, the target temperature of the lower roller 61 increases at a higher constant rate (substantially along a straight line in FIG. 8) as the thickness of the recording medium 15 increases from 120 μm to 140 μm, so that the difference between the target temperatures of the upper and lower rollers 51 and 61 decreases.

If the recording medium 15 is thinner than 120 μm, the hot offset may generate because the lower roller 61 may be excessively heated in the duplex printing. However, in Embodiment 4, the temperature of the lower roller 61 is relatively low when the thickness of the recording medium 15 is thinner than 120 μm, and therefore the generation of the hot offset can be prevented. Moreover, if the recording medium 15 is thicker than 120 μm, the cold offset may generate because the heat applied to the upper roller 51 is insufficient. However, in Embodiment 4, the temperature of the lower roller 61 is relatively high when the thickness of the recording medium 15 is thicker than 120 μm, and therefore the generation of the cold offset can be prevented.

Figure 9:
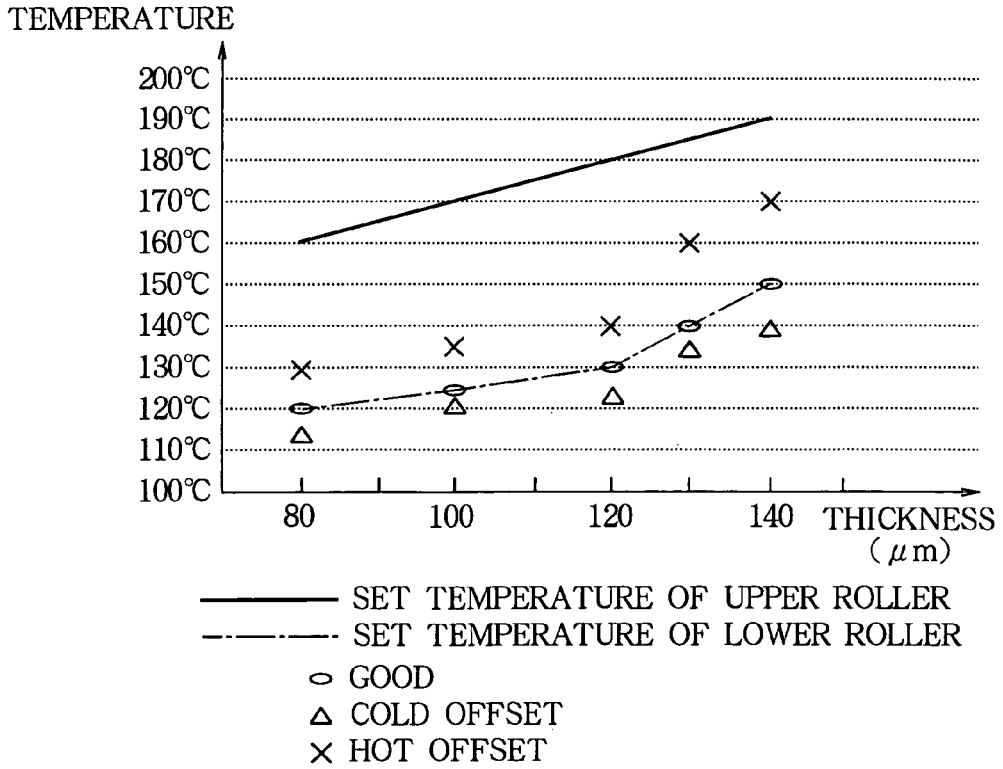
FIG. 9 is a graph illustrating an experimental result on a fixing property with respect to the temperature of the lower roller when the target temperature of the upper roller increases as the thickness of the recording medium increases.

FIG. 9 is a graph illustrating the experimental result on a fixing property when the thickness of the recording medium 15 ranges from 80 μm to 140 μm.

As shown in FIG. 9, if the temperature of the lower roller 61 is on a straight line from 120° C. (first set temperature) to 130° C. (second set temperature) with the thickness of the recording medium 15 ranging from 80 μm (first thickness) to 120 μm (second thickness), neither hot offset nor cold offset is observed, and an excellent fixing property is obtained. Further, if the temperature of the lower roller 61 is on a straight line from 130° C. to 150° C. (third set temperature) with the thickness of the recording medium 15 ranging from 120 μm to 140 μm (third thickness), neither hot offset nor cold offset is observed, and the excellent fixing property is obtained.

On the other hand, if the temperature of the lower roller 61 is lower than the target temperature, the hot offset is observed. Moreover, if the temperature of the lower roller 61 is higher than the target temperature, the cold offset is observed.

In Embodiment 4, the thickness of the recording medium 15 is detected by the thickness sensor 6 as described above. However, it is possible that the information of the thickness of the recording medium 15 is inputted to the control unit 101 via a not shown input unit, and the control unit 101 sets the target temperatures of the upper and lower rollers 51 and 61 based on the inputted thickness of the recording medium 15.

As described above, according to the image forming apparatus of Embodiment 4, the rate of increase of the set temperature becomes greater when the thickness of the recording medium exceeds the predetermined thickness (i.e., 120 μm). Therefore, it is possible to prevent the occurrence of the hot offset even when the recording medium 15 is relatively thin, and the occurrence of the cold offset even when the recording medium 15 is relatively thick.

While the preferred embodiments of the present invention have been illustrated in detail, it should be apparent that modifications and improvements may be made to the invention without departing from spirit and scope of the invention as described in the following claims.

What is claimed is:

1. An image forming apparatus comprising:

a feeding mechanism that feeds a recording medium;

an image forming unit that transfers an image of a recording material to said recording medium fed by said feeding mechanism;

a heating member that applies heat to said image on said recording medium;

a pressing member provided in opposition to said heating member;

an urging member that urges said pressing member against said heating member, said recording medium being pressed between said heating member and said pressing member; and a control system that determines an interval between a preceding recording medium and a subsequent recording medium fed next to said preceding recording medium, wherein said control system causes said urging member to release urging of said pressing member when said control system determines that said interval is greater than a predetermined value.

2. The image forming apparatus according to claim 1, wherein said preceding recording medium corresponds to a recording medium being fed for forming an image on one of first and second sides of said recording medium in a duplex printing operation, and said subsequent recording medium corresponds to a recording medium being fed for forming an image on the other of said first and second sides in said duplex printing operation.

3. The image forming apparatus according to claim 1, wherein said control system determines said interval based on time.

4. The image forming apparatus according to claim 1, wherein said control system determines said interval based on distance.

5. An image forming apparatus comprising:

a feeding mechanism that feeds a recording medium;

an image forming unit that transfers an image of a recording material to said recording medium fed by said feeding mechanism;

a heating member that applies heat to said image on said recording medium and rotates to feed said recording medium in a predetermined direction;

a pressing member provided in opposition to said heating member;

an urging member that urges said pressing member against said heating member, said recording medium being pressed between said heating member and said pressing member; and a control system that determines an interval between a preceding recording medium and a subsequent recording medium fed next to said preceding recording medium, wherein said control system causes said heating member to stop rotating for a predetermined period when said control system determines that said interval is greater than a predetermined value.

6. The image forming apparatus according to claim 5, wherein said preceding recording medium corresponds to a recording medium being fed for forming an image on one of first and second sides of said recording medium in a duplex printing operation, and said subsequent recording medium corresponds to a recording medium being fed for forming an image on the other of said first and second sides in said duplex printing operation.

7. The image forming apparatus according to claim 5, wherein said control system determines said interval based on time.

8. The image forming apparatus according to claim 5, wherein said control system determines said interval based on distance.

9. An image forming apparatus having a function to perform first and second operations for respectively forming images on first and second sides of a recording medium, said image forming apparatus comprising:

a feeding mechanism that feeds said recording medium;

an image forming unit that transfers said image of a recording material to said recording medium fed by said feeding mechanism;

a heating member that applies heat to said image on said recording medium and rotates to feed said recording medium in a predetermined direction;

a pressing member provided in opposition to said heating member;

an urging member that urges said pressing member against said heating member, said recording medium being pressed between said heating member and said pressing member;

a medium detection unit that detects said recording medium fed by said feeding mechanism at a predetermined position and outputs a detection signal; and a control unit that causes said urging member to urge said pressing member only during a first period in accordance with said detection signal in said first operation, and causes said urging member to urge said pressing member only during a second period in accordance with said detection signal in said second operation.

10. An image forming apparatus having a function to perform first and second operations for respectively forming images on first and second sides of a recording medium, said image forming apparatus comprising:

a feeding mechanism that feeds said recording medium;

an image forming unit that transfers said image of a recording material to said recording medium fed by said feeding mechanism and rotates to feed said recording medium in a predetermined direction;

a heating member that applies heat to said image on said recording medium and rotates to feed said recording medium in a predetermined direction; and a pressing member provided in opposition to said heating member;

an urging member that urges said pressing member against said heating member, said recording medium being pressed between said heating member and said pressing member;

a medium detection unit that detects said recording medium fed by said feeding mechanism at a predetermined position and outputs a detection signal; and a control unit that causes said urging member to urge said pressing member during a third period, said third period starting in accordance with said detection signal in said first operation, and said third period ending in accordance with an end of said detection signal in said second operation, wherein said control system causes said heating member to stop rotating during a fourth period within said third period, said fourth period starts in accordance with an end of said detection signal in said first operation, and said fourth period ends in accordance with said detection signal in said second operation.

11. An image forming apparatus that forms an image of a recording material on a recording medium, said image forming apparatus comprising:

a thickness detection unit that detects the thickness of said recording medium;

a fixing unit that fixes said image to said recording medium at a fixing temperature corresponding to a thickness of said recording medium; and a control system that determines said fixing temperature based on first, second and third set temperatures respectively corresponding to first, second and third thicknesses of said recording medium, said second thickness being thicker than said first thickness, said third thickness being thicker than said second thickness, said second set temperature being higher than said first set temperature, and said third set temperature being higher than said second temperature, wherein a set temperature substantially linearly increases from said first set temperature to said second set temperature as the thickness of said recording medium increases from said first thickness to said second thickness, and a set temperature substantially linearly increases from said second set temperature to said third set temperature as the thickness of said recording medium increases from said second thickness to said third thickness, and wherein a rate of increase of said set temperature is smaller when the thickness of said recording medium is between said first and second thicknesses than when the thickness of said recording medium is between said second and third thicknesses.

12. The image forming apparatus according to claim 11, having a function to form images on first and second sides of said recording medium.

13. An image forming apparatus that forms an image of a recording material on a recording medium, said image forming apparatus comprising:

a thickness setting system for setting a thickness of said recording medium;

a fixing unit having first and second rollers each of which has a heater, said first and second rollers nip said recording medium therebetween and rotate to feed said recording medium, a temperature of said second roller being lower than a temperature of said first roller; and a control system that drives said heaters to control temperatures of said first and second rollers according to the thickness of said recording medium, wherein said temperature of said second roller substantially linearly increases as the thickness of said recording medium increases, and a rate of increase of said temperature is greater when the thickness of said recording medium is thicker than a predetermined thickness than when the thickness of said recording medium is thinner than said predetermined thickness.

14. The image forming apparatus according to claim 13, wherein said thickness setting system comprises:

a thickness sensor disposed on a feeding path of said recording medium; and a calculation unit that calculates the thickness of said recording medium according to an output signal from said thickness sensor.

15. The image forming apparatus according to claim 13, having a function form images on first and second sides of a recording medium.

* * * * *